US012208942B2

(12) United States Patent
Holdsworth

(10) Patent No.: US 12,208,942 B2
(45) Date of Patent: Jan. 28, 2025

(54) SELF-CONTAINED CONTINUOUS CARTON SYSTEM WITH SELF ERECTING REINFORCED SIDEWALL AND STACKING STAB FOR THE SAME

(71) Applicant: E-Z Set LLC, Medford, NJ (US)

(72) Inventor: James Kenneth Holdsworth, Medford, NJ (US)

(73) Assignee: E-Z Set LLC, Medford, NJ (US)

( * ) Notice: Subject to any disclaimer, the term of this patent is extended or adjusted under 35 U.S.C. 154(b) by 9 days.

(21) Appl. No.: 18/067,185

(22) Filed: Dec. 16, 2022

(65) Prior Publication Data

US 2023/0121557 A1 Apr. 20, 2023

Related U.S. Application Data

(63) Continuation-in-part of application No. 17/304,805, filed on Jun. 25, 2021, now Pat. No. 11,603,230, (Continued)

(51) Int. Cl.
*B65D 5/22* (2006.01)
*B65D 5/00* (2006.01)
*B65D 5/02* (2006.01)

(52) U.S. Cl.
CPC ..... *B65D 5/0281* (2013.01); *B65D 5/001* (2013.01); *B65D 5/0227* (2013.01); *B65D 5/22* (2013.01)

(58) Field of Classification Search
CPC ..... B65D 5/001; B65D 5/003; B65D 5/0035; B65D 5/0015; B65D 5/0281; B65D 5/443;
(Continued)

(56) References Cited

U.S. PATENT DOCUMENTS 3,516,593 A * 6/1970 Larsen ..... B65D 5/0245 206/424
5,871,147 A * 2/1999 Smith ..... B65D 5/5016 229/120.17
(Continued)

FOREIGN PATENT DOCUMENTS

AT 522722 A4 * 12/2020 ..... B65D 21/062
JP 05162741 A * 6/1993

*Primary Examiner* — Nathan J Newhouse
*Assistant Examiner* — Phillip D Schmidt
(74) *Attorney, Agent, or Firm* — Squire Patent Consulting & IP Law LLC; Brendan E. Squire

(57) ABSTRACT

A reinforced sidewall for a container carton for shipment and display of products. The reinforced sidewall includes an interior sidewall, an outer sidewall, and a bottom panel that are interconnected for reinforcement of the container sidewall. Some embodiments include a shoulder structure for supporting a container placed atop the container that is automatically deployed when the outer sidewall and the interior sidewall are moved to an upright position relative to the bottom panel. Other embodiments include a shoulder brace that is automatically deployed to support the shoulder in a cantilevered relation with the interior sidewall. A stab tab is also configured to automatically protrude from the top surface of the shoulder. The stab tab is configured to be received in a recess in a superjacent container for indexed stacking of the containers.

17 Claims, 11 Drawing Sheets

Related U.S. Application Data which is a continuation of application No. 16/518,514, filed on Jul. 22, 2019, now Pat. No. 11,130,611.

(60) Provisional application No. 62/701,129, filed on Jul. 20, 2018.

(58) Field of Classification Search
CPC .. B65D 5/0227; B65D 5/0245; B65D 5/5007; B65D 5/2004; B65D 5/2009; B65D 71/18; B65D 2751/00259
See application file for complete search history.

(56) References Cited

U.S. PATENT DOCUMENTS

| | | | | |
|---|---|---|---|---|
| 6,675,970 | B1 * | 1/2004 | Nemoto | B65D 5/5061 206/592 |
| 9,957,085 | B2 * | 5/2018 | Bourdin | B65D 5/12 |
| 11,130,611 | B2 * | 9/2021 | Holdsworth | B65D 5/4608 |
| 2002/0190113 | A1 * | 12/2002 | Holdsworth | B65D 5/0035 229/164 |

* cited by examiner

SELF-CONTAINED CONTINUOUS CARTON SYSTEM WITH SELF ERECTING REINFORCED SIDEWALL AND STACKING STAB FOR THE SAME

CROSS-REFERENCE TO RELATED APPLICATION

This application is a continuation-in-part of U.S. patent application Ser. No. 17/304,805, filed Jun. 25, 2021, which is a continuation of U.S. Pat. No. 11,130,611, issued Sep. 28, 2021, and claims benefit of priority to U.S. provisional application No. 62/701,129, filed Jul. 20, 2018, the contents of which are herein incorporated by reference.

BACKGROUND OF THE INVENTION

The present invention relates to dual function shipping and display corrugated packages, referred to as PDQ's (pretty darn quick), and more particularly to continuous PDQ's. These PDQ's serve for shipment of goods and convert to display the goods in retail environments.

Current glued designs for PDQ's require adding an additional fifth panel to the side flaps which is adhered to the bottom flaps. Because there is no structural support between the outer and inner side walls of the carton, there is a high probability of inner wall deflection/imploding when subjected to the weight of packages stacked on top. This adds stress to the front lip of the box which in turn kinks, causing additional imploding of the side walls. Non-glued PDQ designs also exist with similar issues, which either are not addressed or additional costly reinforcement components are added. These require additional assembly and are less sustainable.

The results can be product damage, restricted access to product, requirements to repack/restack the product on store shelves or endcaps to make the goods more presentable on the sales floor. Current PDQ packages also present safety concerns as the pallet of product is not stable and can collapse or topple over. This can be very problematic when placing in or removing from warehouse storage racks.

With conventional containers, stocking personnel must exercise care while stacking the containers for presentation. The cartons that are stacked atop one another may become dislodged or toppled when they are bumped by a consumer or a consumer's shopping cart. This can present an injury risk to the customers and risks damage to the goods carried within the container.

As can be seen, there is a need for a reinforced sidewall for a container that provide significant reduction/elimination of inner side wall deflection/implosion and front lip kinking. There is also a need for retaining the containers in is makes the container stacks more stable. It also uses less material as it is not adhered to the bottom flaps which makes it a lower cost and more sustainable.

SUMMARY OF THE INVENTION

In one aspect of the invention, a reinforced sidewall for a shipping container is disclosed. The reinforced sidewall includes an outer sidewall that is joined with a bottom panel along a bottom fold line. An interior sidewall is joined with the outer sidewall along a top fold line, opposite the bottom fold line and spaced apart by a dimension corresponding to a height of the reinforced sidewall. A first pleat is joined with the interior sidewall along a first pleat fold line opposite the top fold line. A second pleat is joined with the first pleat along a second pleat fold line opposite the first pleat fold line. The second pleat is adapted to be joined with the bottom panel along the bottom fold line when the interior sidewall is folded along the top fold line to overlie an inner face of the outer sidewall, such that when the outer sidewall and the interior sidewall are folded towards the bottom panel along the bottom fold line, the second pleat is folded along the second pleat fold line to overlie the first pleat and position the interior sidewall in a cantilevered supporting relation with the outer sidewall.

In some embodiments, a portion of one or more of the bottom fold line, the top fold line, the first pleat fold line, and the second pleat fold line includes a score line aligned with a corresponding fold line. In some embodiments, a lateral side edge of the interior sidewall is inset relative to a lateral side edge of the outer sidewall.

In some embodiments, a slot cutout is defined along a portion of the first pleat fold line, the slot cutout is configured to facilitate a folding of the first pleat along the first pleat fold line, before a folding of the second pleat along the second pleat fold line.

In other aspects of the invention a reinforced sidewall with a shoulder brace is disclosed. The reinforced sidewall includes an outer sidewall joined with a bottom panel along a bottom fold line. The bottom panel forms at least a portion of a bottom of the container. A shouldered section is joined with the outer sidewall along a top fold line opposite the bottom fold line. An interior sidewall is joined with the shouldered section along a shoulder fold line opposite the top fold line and is spaced apart by a dimension corresponding to a width of a shoulder formed by the shouldered section. A shoulder brace is interposed between the shouldered section and an interior sidewall. The shoulder brace is joined with the interior sidewall along a shoulder brace fold line, opposite the shoulder fold lin. The shoulder brace is configured to automatically deploy in a cantilevered supporting relation between the interior sidewall and the shoulder when the outer sidewall and the interior sidewall are folded towards the bottom panel along the bottom fold line to an upright position.

In some embodiments, the shouldered section also includes a first shoulder section and a second shoulder section joined along an intermediate shoulder fold line.

In other embodiments, a stab structure is configured to automatically protrude from an intermediate portion of the shoulder when the outer sidewall and the interior sidewall are folded to the upright position. The stab structure may also include a pair of stab cut lines defined in the intermediate portion of the shoulder. The pair of stab cut lines extend between the top fold line and the shoulder brace fold line. An outer stab tab extends from the top fold line and disposed between the pair of stab cut lines. An inner stab tab extending from the shoulder brace fold line and disposed between the pair of stab cut lines. The outer stab tab and the inner stab tab are configured to automatically protrude above the shoulder when the interior sidewall and the outer sidewall are moved to the upright position.

In other embodiments, the inner stab tab and the outer stab tab are joined along a stab fold line and form an angled stab. In some embodiments, a stab shoulder is interposed between the outer stab tab and the inner stab tab. The stab shoulder is joined with the inner stab tab along a stab shoulder fold line and joined with the outer stab tab along an intermediate shoulder fold line.

In yet other embodiments, a vertical truss kick-in is formed by a lower truss fold line and a pair of cut lines defined in the bottom panel, wherein the lower truss fold line is parallel to and spaced apart from the bottom fold line. The pair of cut lines extend between the lower truss fold line and the bottom fold line. The vertical truss kick-in is adherable to a surface of the interior sidewall using an adhesive.

In other aspects of the invention a reinforced sidewall with a stab structure is disclosed. The reinforced sidewall includes an outer sidewall joined with a bottom panel along a bottom fold line. A shoulder section is joined with the outer sidewall along a top fold line opposite the bottom fold line. An interior sidewall is joined with the shoulder section along a shoulder fold line opposite the top fold line. A stab structure is defined between a pair of stab cut lines extending between the outer sidewall and the interior sidewall through an intermediate portion of the shoulder section. With the interior sidewall folded about the shoulder fold line to overlie the outer sidewall, the shoulder section and the stab structure are configured to automatically move to deploy a shoulder of the shoulder section when the outer sidewall and the interior sidewall are folded towards the bottom panel along the bottom fold line to an upright position.

In some embodiments, an outer stab tab is defined along a top edge of the outer sidewall and protrudes beyond the top fold line. An inner stab tab is defined along a top edge of the interior sidewall and protrudes beyond the shoulder fold line. A stab shoulder is interposed between the inner stab tab and the outer stab tab. The inner stab tab, the outer stab tab, and the stab shoulder form a shouldered stab protrusion when the outer sidewall and the interior sidewall are folded to the upright position.

In some embodiments, the shoulder section also includes a first shoulder section connected with the outer sidewall. A second shoulder section is connected with the interior sidewall. An intermediate shoulder fold line connects the first shoulder section and the second shoulder section.

In some embodiments, a shoulder brace is defined between the shoulder fold line and a shoulder brace fold line. The shoulder brace is configured to deploy to a cantilevered supporting relation between the shoulder and the interior sidewall when the outer sidewall and the interior sidewall are folded to the upright position.

In some embodiments, an engagement slot is defined in the bottom panel. An engagement tab is defined at a distal end of the interior sidewall. The engagement slot is configured to receive the engagement tab when the interior sidewall and the outer sidewall are folded to the upright position.

In other embodiments, a vertical truss kick-in is formed by a lower truss fold line and a pair of cut lines defined in a bottom tab. The lower truss fold line is parallel to and spaced apart from the bottom fold line. The pair of cut lines extend between the lower truss fold line and the bottom fold line and the vertical truss kick-in is adherable to a surface of the interior sidewall using an adhesive. The lower truss fold line is offset from the bottom fold line by a distance corresponding to a width of the shoulder.

In other embodiments, an upper attachment of a horizontal truss kick-in to the outer sidewall along an upper truss fold line that is offset from the bottom fold line by the distance corresponding to the width of the shoulder.

In yet other embodiments, when the bottom tab is folded inwardly from the outer sidewall, the vertical truss kick-in is positioned in abutment with an outwardly facing surface the interior sidewall and the horizontal truss kick-in spans a gap between the outer sidewall and the interior sidewall.

These and other features, aspects and advantages of the present invention will become better understood with reference to the following drawings, description and claims.

DETAILED DESCRIPTION OF THE INVENTION

Figure 1A:
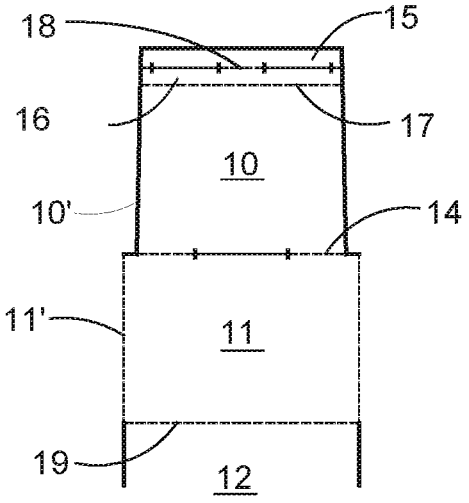
FIG. 1*a* is a plan view of a first embodiment of a multi-function reinforced sidewall for a self-contained continuous carton system (SC3S) laid out flat.
Figure 1B:
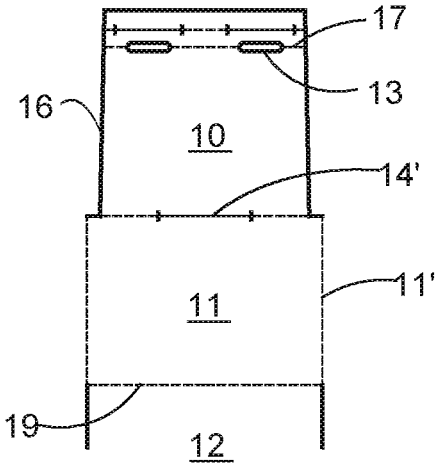
FIG. 1*b* is a plan view of the multi-function reinforced sidewall for the SC3S laid out flat.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved self-contained continuous carton system with erecting reinforced shoulders and stacking stab. Aspects of the invention provide a dual purpose PDQ with structural integrity for withstanding the rigors of the entire supply chain and as well as serving as a product display vehicle.

The reinforced shoulders to support stacking of one or more additional cartons on top of the reinforced shoulders to significantly reduce the incidence of the shoulders collapsing or buckling. A stacking stab protrudes from a top surface of the reinforced shoulder. The stacking stab is configured to engage with a recess defined in a bottom of a display carton stacked on the shoulder to retain the stacked carton in engagement with the subjacent display carton. The recess may be defined in a side panel and a bottom panel of the self-contained continuous carton system as described in U.S. Pat. No. 11,130,611 and U.S. patent application Ser. No. 17/304,805, which define an alcove with a secondary purpose as a hand hold that facilitates carriage and stacking of the carton by warehouse and stocking workers.

Aspects of the present invention include features for a reinforced side panel for a continuous carton system (SC3S) container. For ease of description, other panels of the SC3S are omitted. In the drawings, fold lines are shown with a dashed line, score lines are depicted with a solid line with intersecting bars at the ends, and cut lines shown in solid lines. A fold line is a marking or depression defined along the surface of the carton material, such as corrugated cardboard. A score line is a partial cut into the surface of the carton material and may be indicated with a prime mark, ', following the associated reference number. For ease of description, the score line reference numbers may be omitted from the description. A cut line is defined as a cut extending through the carton material.

A first non-limiting embodiment of a multi-function reinforced sidewall for a container is shown in reference to FIGS. 1*a*-1*d*. The multi-function reinforced side panel includes an interior sidewall 10, an outer sidewall 11, and a bottom panel 12. The bottom panel 12 forms at least a portion of a bottom of the SC3S. The multi-function reinforced sidewall is configured to automatically erect when folded to form the SC3S.

The interior sidewall 10 is joined with the outer sidewall 11 along an upper fold line 14. An intermediate section of the upper fold line 14 may include a score line 14' to facilitate folding of the interior sidewall 10 along the upper fold line 14. Side edges 16 of the interior sidewall 10 may be inset to avoid interference with the inner sidewalls of the SC3S when the reinforced sidewall is erected. The outer sidewall 11 may be joined with adjacent sections of the SC3S along one or more side edges 11'. The bottom panel 12 is joined with the outer sidewall 11 along a bottom fold line 19.

The interior sidewall 11 has a pleat defined at a distal end, opposite the upper fold line 14. The pleat includes a first pleat 16 and a second pleat 15 that are formed with a first pleat line 17 and a second pleat line 18, disposed between the first pleat line 17 and the distal end of the interior sidewall 11. Each of the first pleat line 17 and the second pleat line 18 may include one or more of a score line 18' or a slot cutout 13 along a portion thereof to facilitate folding. The slot cutout 13 defined along a portion of the first pleat fold line 18. The slot cutout 13 configured to facilitate a folding of the first pleat 16 along the first pleat fold line 17, before a folding of the second pleat 15 along the second pleat fold line.

Figure 1C:
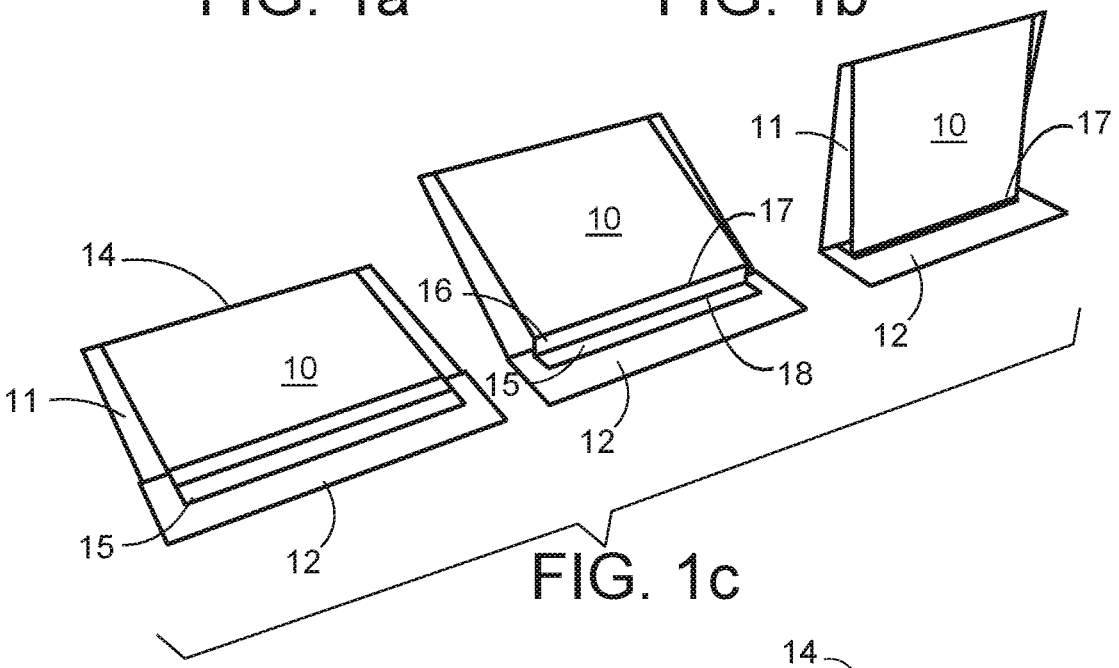
FIG. 1*c* is a stepwise view of a first assembly and deployment of the multi-function reinforced sidewall for the SC3S.
Figure 1D:
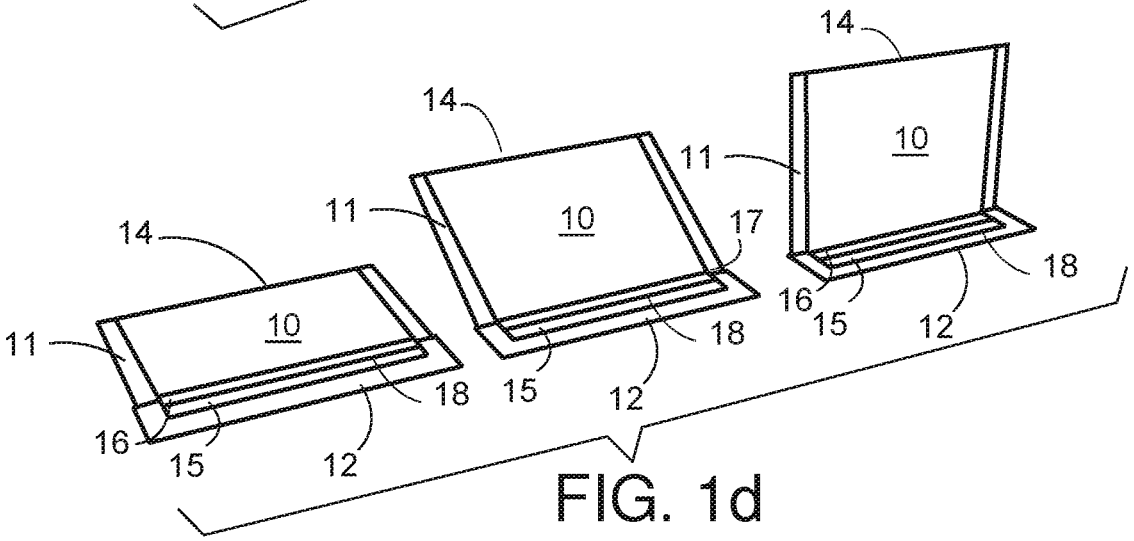
FIG. 1*d* is a stepwise view of an alternative assembly and deployment of the multi-function reinforced sidewall for the SC3S.

Assembly and erection of a first functional structure of the multi-function reinforced sidewall is shown in reference to the drawings of FIGS. 1*c* and 1*d*. In FIG. 1*c*. A first step, the interior sidewall 10 is folded along the upper fold line 14 to overly an inner surface of the outer sidewall 11. An inner surface of the second pleat 15 may be joined with the bottom panel 12 with a fastener 15', such as a staple, or an adhesive.

As the overlapping outer sidewall 11 and the interior sidewall 10 are rotated towards the bottom panel 12, the interior sidewall 10 will be urged inwardly along the first pleat line 17 and the first pleat 16 and the second pleat 15 will fold towards each other along the second pleat line 18. When the outer sidewall 11 and the interior sidewall 10 are in an upright condition, the first pleat 16 will overly the second pleat 15 with the interior sidewall 10 bracing the outer sidewall 11 in a cantilevered supporting relation with the outer sidewall 11 positioned in the upright condition. When a height of the interior sidewall 10 is greater than that of the outer sidewall 11, the interior sidewall 10 will act as a brace for the reinforced sidewall.

A second functional structure of the multi-function reinforced sidewall is seen in reference to FIG. 1*d*. In this embodiment, the adhesive or fastener may be omitted, or applied to each of the first pleat 16 and the second pleat 15, the outer sidewall 11 and the interior sidewall 10 provide a double walled reinforcement for the SC3S.

An embodiment of the SC3S with a shouldered stab structure is shown in reference to the drawings of FIGS. 2*a*-2*d*. In this embodiment an articulating shoulder surface is provided at the top edge of the reinforced sidewall of the SC3S with the shouldered stab 30 interposed between the articulating shoulder surface. As seen in reference to FIGS. 2*a* and 2*b*, the reinforced sidewall includes an interior sidewall 20 and an outer sidewall 21, and a bottom panel 22. The outer sidewall 21 is joined with the bottom panel 22 along a bottom fold line 23. The bottom panel 22 forms at least a portion of the bottom of the SC3S, when formed. In the embodiment shown in FIGS. 2*a* and 2*b*, a folding recess 110 is defined between the outer sidewall 21 and the bottom panel 22.

Figure 2B:
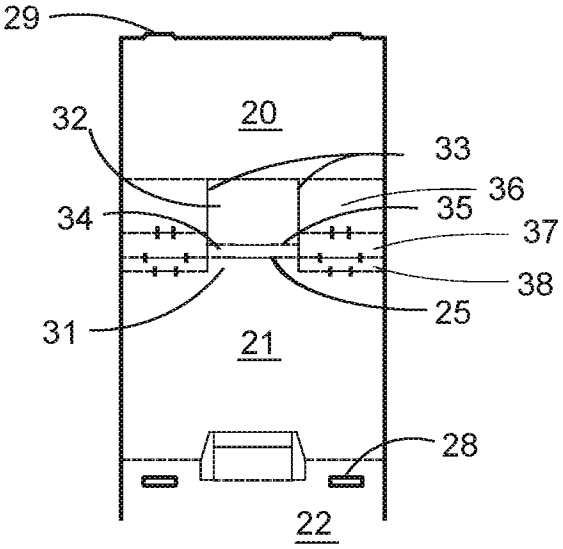
FIG. 2*b* is the first plan view of the second embodiment of the reinforced sidewall for the SC3S, with the stab and shoulder elements itemized separately for clarity.
Figure 2A:
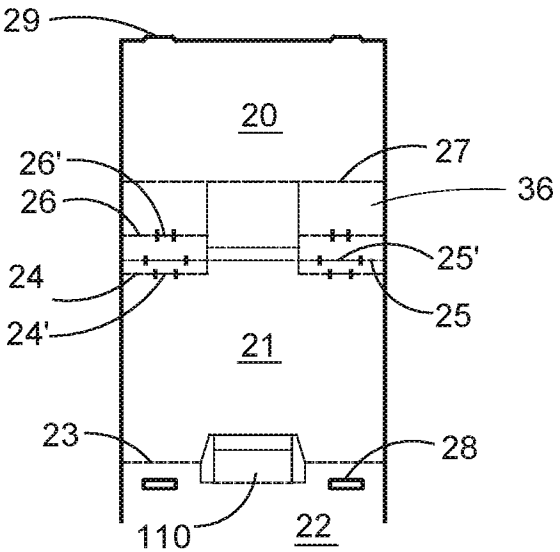
FIG. 2*a* is a first plan view of a second embodiment of a reinforced sidewall with an articulating shoulder and shouldered stab, showing major panels and detailing fold, score, and cut lines.

Referring first to FIG. 2*a*, the articulating shoulder surface is formed between the outer sidewall 21 and the interior sidewall 20 between a top fold line 24 and a shoulder fold line 26. The shoulder fold line 26 extends partially across a top end of the outer sidewall 21, with a portion of the shouldered stab structure 30 interrupting the top fold line segments 26 at an intermediate position between opposed side edges of the outer sidewall 21. The top fold line 24 is spaced apart from the shoulder fold line 26 by a distance corresponding to a width of the shoulder. An intermediate shoulder fold line 25 is spaced apart from the top fold line 24 by a distance corresponding to a height of the shouldered stab 30 protrusion from a top surface of the shoulder.

An engagement slot 28 may be defined in the bottom panel 22. A corresponding engagement tab 29 is defined at a distal end of the interior panel 20. The engagement tab 29 is dimensioned to be received within the engagement slot, when the reinforced sidewall of the SC3S is formed.

Referring next to FIG. 2*b*, the shouldered stab 30 structure is shown defined between the interior sidewall 20 and the outer sidewall 21. The shouldered stab 30 includes an outer stab tab 31 protruding from a top end of the outer sidewall 21 interposed between segments of the top fold line 24 and terminating at an intermediate shoulder fold line 25. An inner stab tab 32 extends from the top fold line 24 and terminates at a stab shoulder fold line 35. The stab shoulder fold line 35 is spaced apart from the intermediate shoulder fold line 25 by a distance corresponding to a width of a stab shoulder surface 34.

Figure 2C:
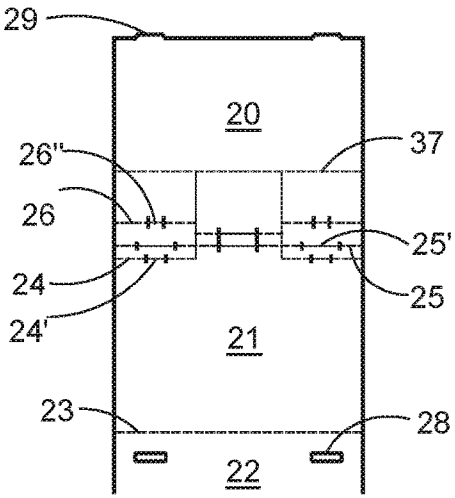
FIG. 2*c* is a plan view of the second embodiment of the reinforced sidewall for the SC3S.

A pair of stab cut lines 33 are defined between the top fold line 24 and the shoulder brace fold line 27. The pair of stab cut lines 33 are disposed in a parallel spaced apart relation corresponding to a length of the shouldered stab 30. The pair of stab cut lines 33 intersect each of the shoulder fold line 26 and the intermediate shoulder fold line 25. The structure of FIG. 2*c* illustrates the shouldered stab structure with the folding recess 110 omitted.

Figure 2D:
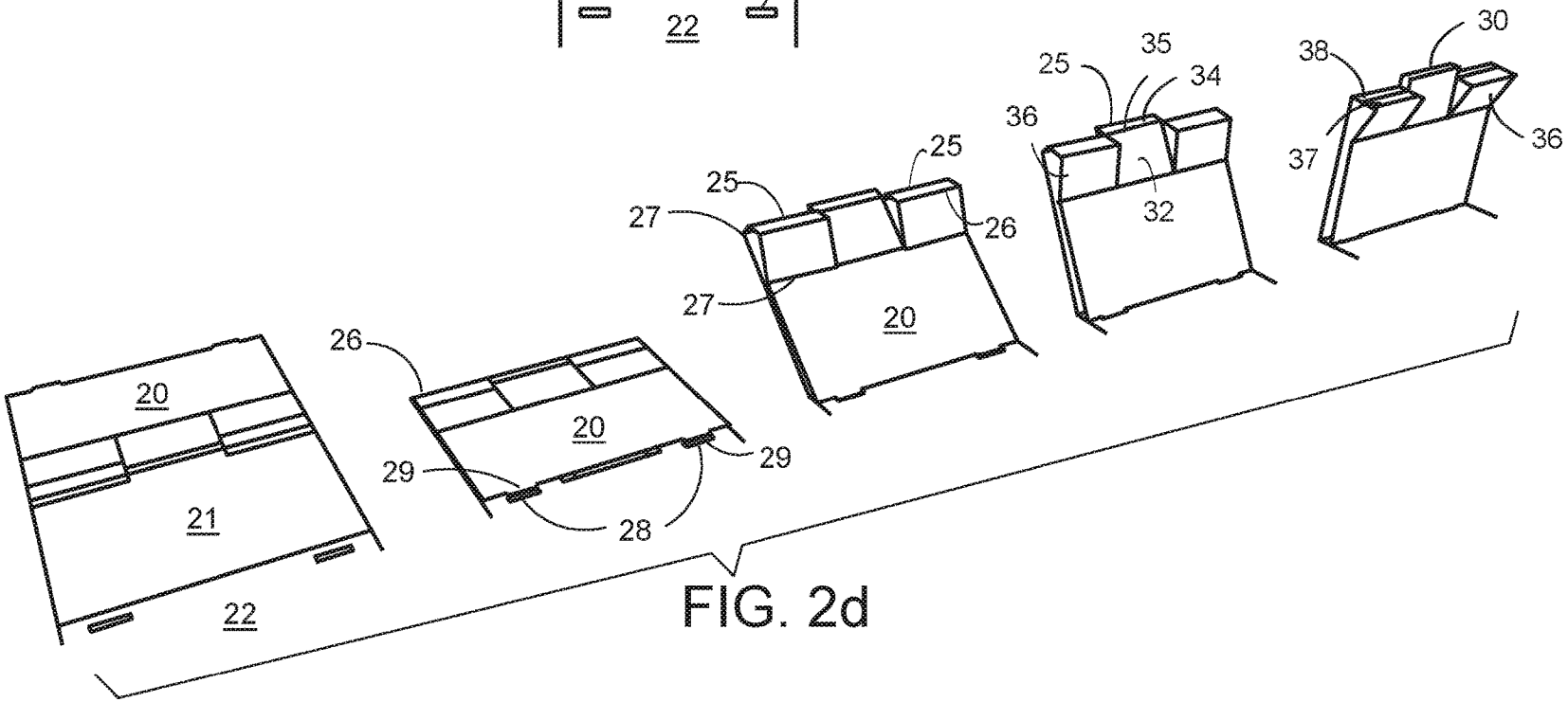
FIG. 2*d* is a stepwise view of an assembly and deployment of the second embodiment of the reinforced sidewall with articulating shoulder and shouldered stab.

Assembly and erection of the shouldered stab structure with articulating shoulder is shown in reference to FIG. 2*d*. In a first step, the interior sidewall 10 is folded along the intermediate shoulder fold line 25 so that the interior sidewall 10 overlies an interior surface of the outer sidewall 11. The engagement tabs 29 are indexed with the corresponding engagement slot 28. As the outer sidewall 11 and interior sidewall 10 are elevated and rotated inwardly relative to the bottom panel 22, the engagement of the engagement tabs 29 with the engagement slots 28 urges the interior sidewall upwardly to deploy each of the shoulder surfaces 37 and the shouldered stab 30.

The shoulder surface 37, 38 is deployed by a flexing of the shoulder area about the top fold line 24, the intermediate shoulder fold line 25, the shoulder fold line 26, and the shoulder brace fold line 27 with a separation at the stab cut lines 33. A shoulder brace 36 of the shoulder area is cantilevered inwardly towards an interior of the SC3S by a flexing about the shoulder brace fold line 27 and the shoulder fold line 26. As the rotation continues to an upright position of the interior sidewall 10 and the outer sidewall 11, the shoulder surfaces 37, 38 are urged into a flattened condition to define the shoulder surface.

Simultaneously, the shouldered stab 30 is deployed to its upright condition protruding from an intermediate portion of the shoulder surface 37, 38. When the shoulder surfaces 37, 38 separate along the stab cut line 33, the relative movement of the inner stab tab 32 with the interior sidewall 20 causes a flexing along the stab shoulder fold line 35 which progressively urges the stab shoulder 34 to a deployed condition, protruding above the adjacent shoulder surfaces 37, 37'. A flattening of the shoulder surface 37, 37', such as by placement of a superjacent carton on the shoulder surface 37, 37', urges the shoulder brace 36 to its fully deployed, cantilevered position.

A third embodiment of a reinforced sidewall for a SC3S container is shown in reference to FIGS. 3*a*-3*d*. In this embodiment, the reinforced sidewall includes a shoulder surface 57 and a protruding stab 50 forming a top surface of the reinforced sidewall when deployed. The embodiments shown in FIGS. 3*a* and 3*b* have an optional folding recess 110 formed in the sidewall and the bottom of the container, while the embodiment shown in FIG. 3*c* the folding recess 110 is omitted.

As with the previous embodiments, the reinforced sidewall includes an interior sidewall 40, an outer sidewall 41, and a bottom panel 42. The bottom panel 42 forms at least a portion of the bottom of the SC2S container and is joined with the outer sidewall 41 along a bottom fold line 43. The interior sidewall 40 is joined with a shoulder brace 56 along a shoulder brace fold line 44. One or more segments of the top fold line 44 may include a score line 44' to facilitate folding of the interior panel 40 about the top fold line 44. A shoulder fold line 45 is spaced apart from the top fold line 44 by a distance corresponding to a width of the shoulder 57. Likewise the shoulder fold line 45 is spaced apart from an shoulder brace fold line 46 by a distance corresponding to a width of a shoulder brace 56. The shoulder brace fold line 46 is interposed between the shoulder surface 57 and the outer sidewall 41.

Figure 3B:
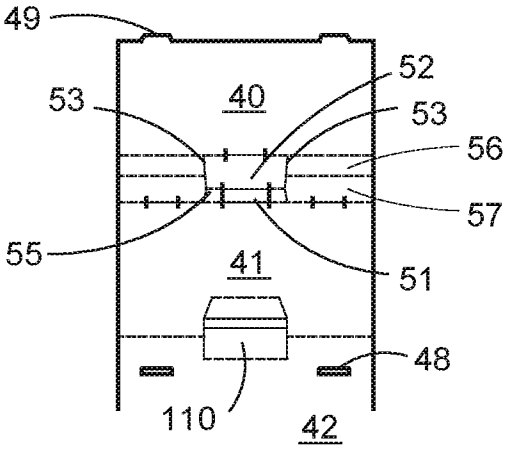
FIG. 3*b* is a plan view of the third embodiment of the reinforced sidewall for the SC3S.
Figure 3A:
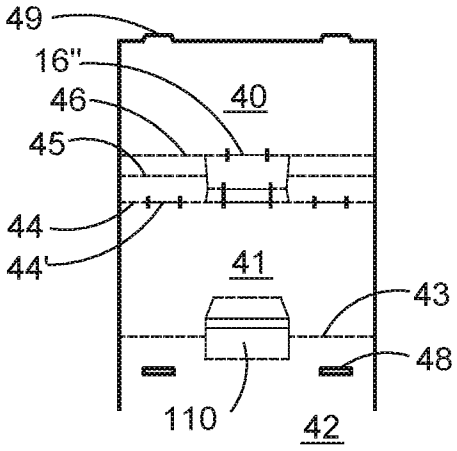
FIG. 3*a* is a plan view of a third embodiment of the reinforced sidewall with an articulating shoulder and angled stab detailing primary panels and fold, score, and cut lines of the reinforced sidewall for the SC3S.
Figure 3C:
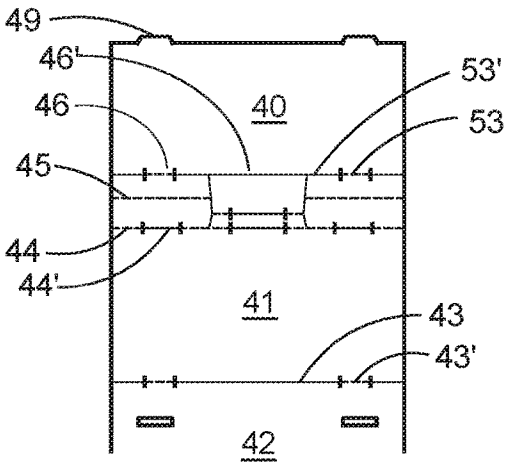
FIG. 3*c* is a plan view of a third embodiment of the reinforced sidewall for the SC3S.

As seen in reference to FIG. 3*b*, a stab structure 50 is located at an intermediate position of the shoulder surface 57. The stab structure 50 includes an inner stab tab 52 that is joined with an outer stab tab 51 along a stab fold line 55. As with the embodiments of FIGS. 2*a*-2*d*, the stab structure 50 is automatically deployed to protrude from the shouldered surface 57 when the interior sidewall 40 and the outer sidewall 41 are elevated to an upright, deployed condition. In this embodiment, the stab structure 50 is somewhat simplified from the stab structure 30 of FIGS. 2*a*-2*d*. In this embodiment, the stab structure 50 is deployed as an angular protrusion, rather than a shouldered protrusion. In either case, the stab structure 30, 50 is engageable with a recess, such as the optional folding recess 110, to index a subjacent SC3S with a superjacent SC3S positioned atop the shoulder surface 57 of the reinforced sidewall.

Figure 3D:
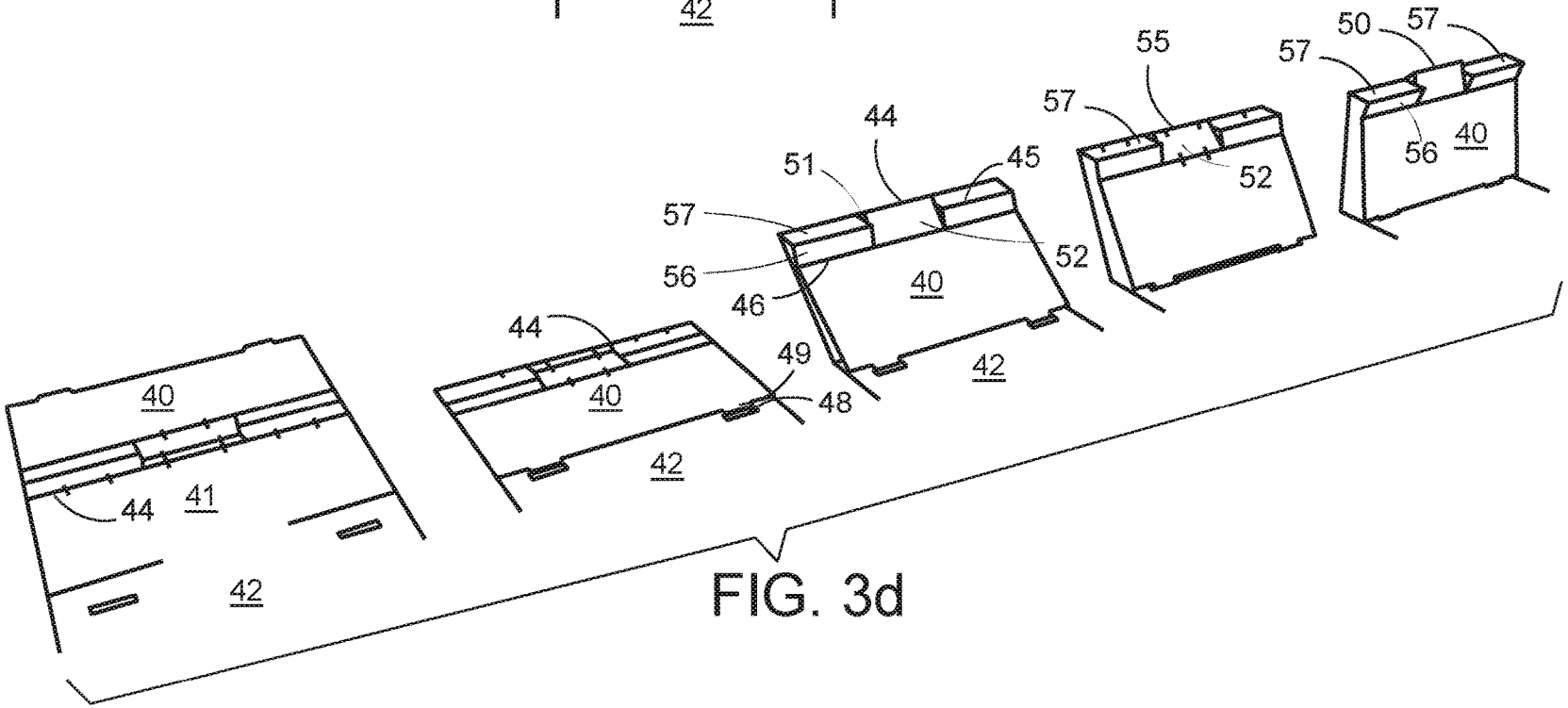
FIG. 3*d* is a stepwise view of an assembly and deployment of the third embodiment of the reinforced sidewall with articulating shoulder and angled stab.

Assembly and erection of the angled stab structure 50 with the shoulder is shown in reference to FIG. 3*d*. In a first step, the interior sidewall 40 is folded inwardly along the top fold line 44. The engagement tabs 49 are engaged with the corresponding slots 48. As the interior sidewall 40 and the outer sidewall 41 are elevated and rotated inwardly the interior sidewall 40 urges the shoulder brace 56 to fold along the shoulder brace fold line 46 and the shoulder 57 to fold along the shoulder fold line 45. As the outer sidewall 41 and the interior sidewall 40 reach their upright condition, the shoulder brace 56 supports the shoulder 57 in a cantilevered supporting position.

Simultaneously, the angled stab structure 50 is automatically deployed to its protruding position. Movement of the interior sidewall 40 urges the inner stab 52 to flex along the stab fold line 55, with a separation of the inner stab 52 and the outer stab tab 51 along the stab cut lines 53. Once deployed, the stab structure 50 is formed as an angled protrusion from the top surface of the shoulder 57. The stab structure 50 is configured to engage with a recess in a bottom surface of a superjacent SC3S placed atop the shoulder 57.

A fourth embodiment of a reinforced sidewall for a SC3S container is shown in reference to FIGS. 4*a*-4*d*. In this embodiment, a shouldered SC3S is provided with a shoulder brace 76 supporting the shoulder surface 77, 78, in a cantilevered manner from the interior sidewall 60. As with other embodiments, the reinforced sidewall includes an interior sidewall 60, an outer sidewall 61, and a bottom panel 62. The bottom panel 62 is joined with the outer sidewall 61 along a bottom fold line 67. The bottom panel 62 forms at least a portion of a bottom of the SC3S.

A top fold line 64 is defined across a top end of the outer sidewall 61. In this embodiment, a first shoulder segment 78 is defined between the top fold line 64 and an intermediate shoulder fold line 65, which may include intermediate shoulder score lines 65'. A second shoulder segment 77 is defined between the intermediate shoulder fold line 65 and a shoulder fold line 66. The first shoulder segment 78 and the second shoulder segment 77 define a shouldered surface for the SC3S when in the deployed condition.

Figure 4B:
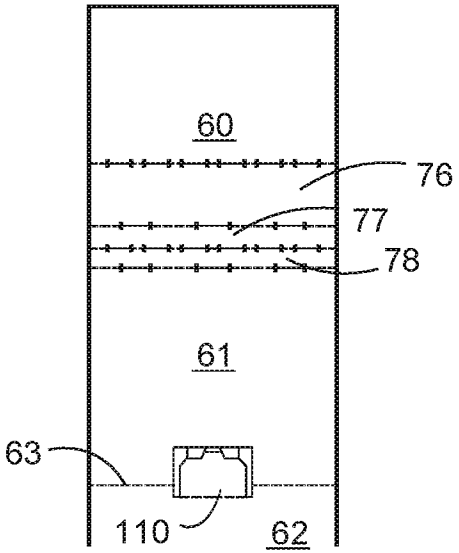
FIG. 4*b* is a second plan view of the cantilevered shoulder reinforced sidewall.
Figure 4A:
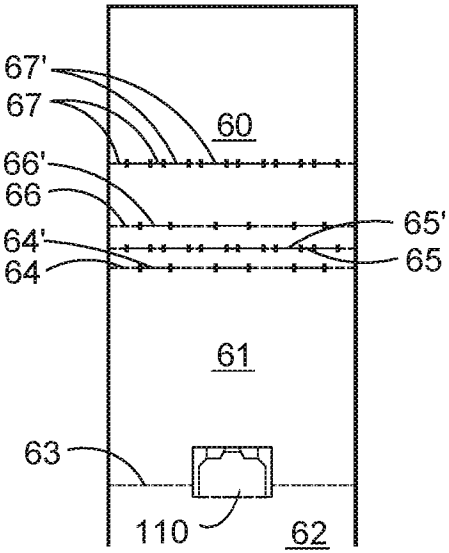
FIG. 4*a* is a first plan view of a fourth embodiment of the reinforced sidewall with a cantilevered shoulder reinforced sidewall for a SC3S.
Figure 4C:
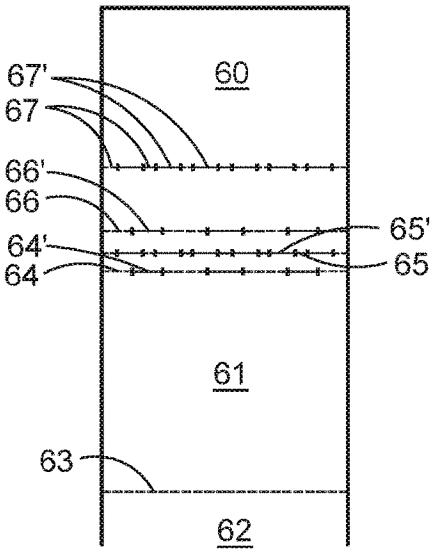
FIG. 4*c* is a third plan view of the cantilevered shoulder reinforced sidewall.

The shoulder brace 76 is defined between the shoulder fold line 66 and a shoulder brace fold line 67, 67'. The shoulder brace 76 provides a cantilevered support for the shouldered surface when the SC3S is configured in the deployed condition. As with other embodiments, the embodiments shown in FIGS. 4*a* and 4*b* are depicted with the optional folding recess 110. In the embodiment shown in FIG. 4*c*, the optional folding recess 110 is omitted.

Figure 4D:
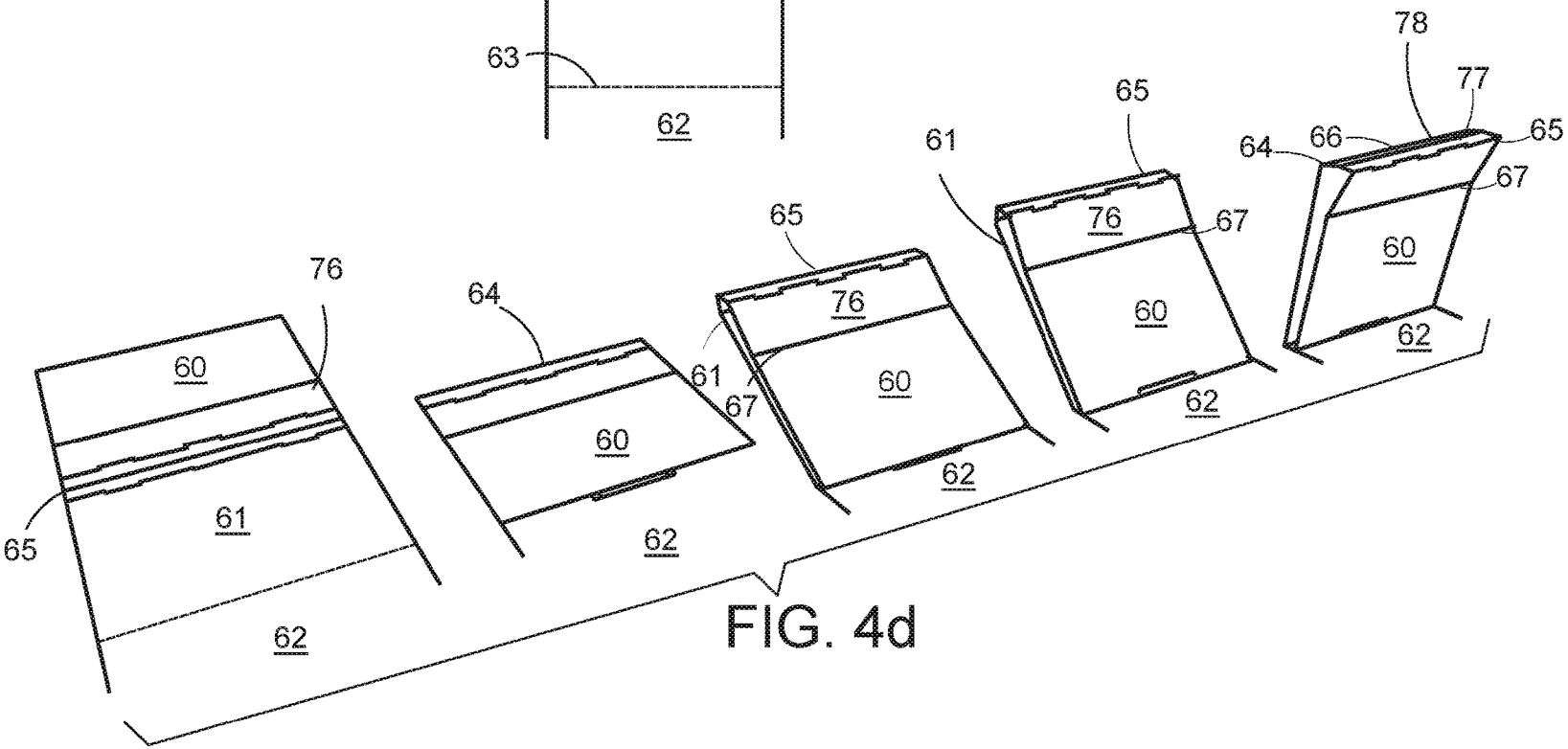
FIG. 4*d* is a stepwise view of an assembly and deployment of the fourth embodiment of the reinforced sidewall with the cantilevered shoulder.

Assembly and erection of the shoulder 77, 78 with cantilevered shoulder support 76 is shown in reference to FIG. 4*d*. In a first step, the interior sidewall 60 is folded inwardly along the top fold line 64 so that the interior sidewall 60 overlies the outer sidewall 61. As the interior sidewall 60 and the outer sidewall 65 are elevated and rotated inwardly relative to the bottom panel 62, movement of the interior sidewall 60 urges against the shoulder brace 76 causing a flexure along the shoulder brace fold line 67, the shoulder fold line 66, the intermediate shoulder fold line 65, and the top fold line 64. As the interior sidewall 60 and the outer sidewall are elevated to an upright condition, the first shoulder segment 78 and the second shoulder segment 77 deploy to form the shouldered surface of the SC3S, with the shoulder brace 76 deployed to the cantilevered supporting position.

A fifth embodiment of a reinforced sidewall for a SC3S container is shown in reference to FIGS. 5*a*-5*d*. In this embodiment, a shouldered SC3S is provided with a shoulder 97 with a stab structure 90 protruding from the shoulder 97. In this embodiment, the reinforced sidewall includes an interior sidewall 80, an outer sidewall 81, and a bottom panel 82. The bottom panel 82 is joined with a bottom end of the outer sidewall 81 along a bottom fold line 83. The bottom panel 82 forms at least a portion of the bottom of the SC3S, when assembled. A top fold line 84 extends laterally across a top end of the outer panel, opposite the bottom fold line 83. A shoulder 97 is defined between the top fold line 84 and a shoulder fold line 86. The interior panel 80 is joined along the shoulder fold line 86.

A stab structure 80 is provided to automatically deploy from a top surface of the shoulder 97 when the reinforced sidewall is assembled. The stab structure 80 is defined by stab cut lines 93 in an intermediate portion of the interior sidewall 80 and the shoulder 97. The stab structure 80 extends between a stab fold line 87 and the top fold line 84. The stab structure 80 includes a first tab stab 91 defined in the interior sidewall 80 between the stab cut lines 93, the stab fold line 87 and the shoulder fold line 86. A second stab tab 92 and a third stab tab 94 are defined in the shoulder 97 between the stab cut lines 93. A stab fold line 85, about which the second stab tab 92 and the third stab tab 94 will fold, is defined between the shoulder fold line 86 and the top fold line 84. In the embodiment shown in FIGS. 5*a* and 5*b*, the reinforced sidewall is provided with the optional folding recess 110. In the embodiment shown in FIG. 5*c*, the folding recess 110 is omitted.

Figure 5B:
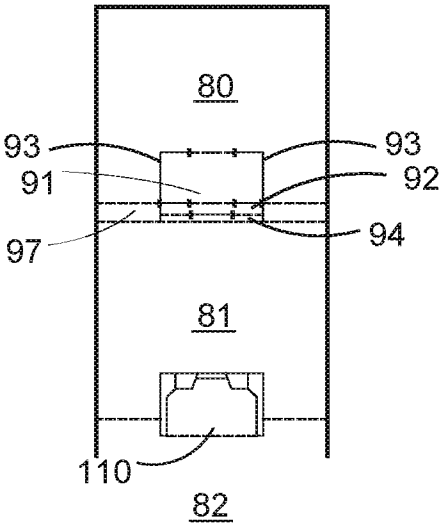
FIG. 5*b* is a second plan view of the fifth embodiment of the reinforced sidewall with a protruding stab.
Figure 5A:
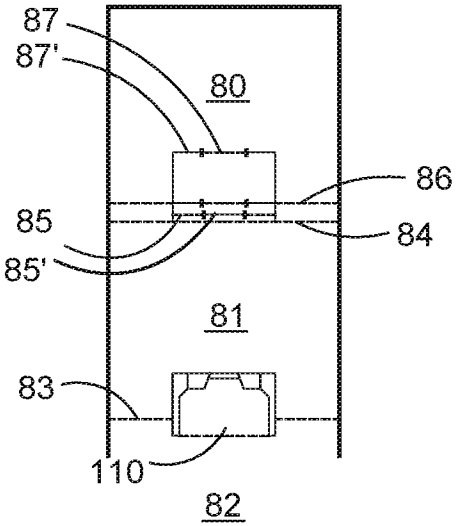
FIG. 5*a* is a first plan view of a fifth embodiment of the reinforced sidewall with a protruding stab.
Figure 5C:
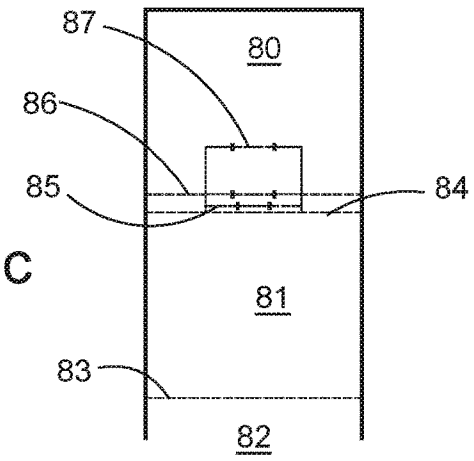
FIG. 5*c* is a third plan view of the fifth embodiment of the reinforced sidewall with a protruding stab.
Figure 5D:
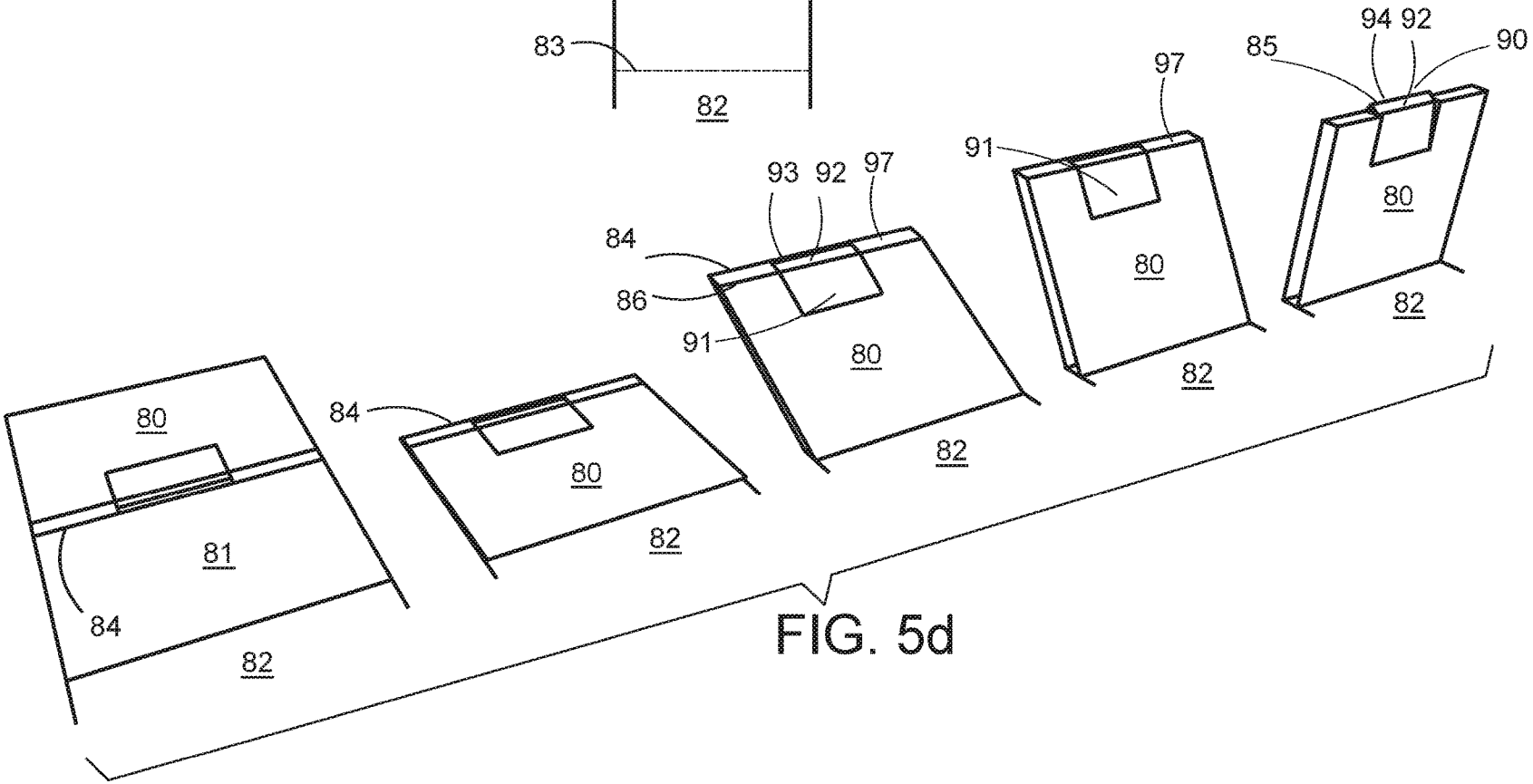
FIG. 5*d* is a stepwise view of an assembly and deployment of the fifth embodiment of the reinforced sidewall with protruding stab.
Figure 6C:
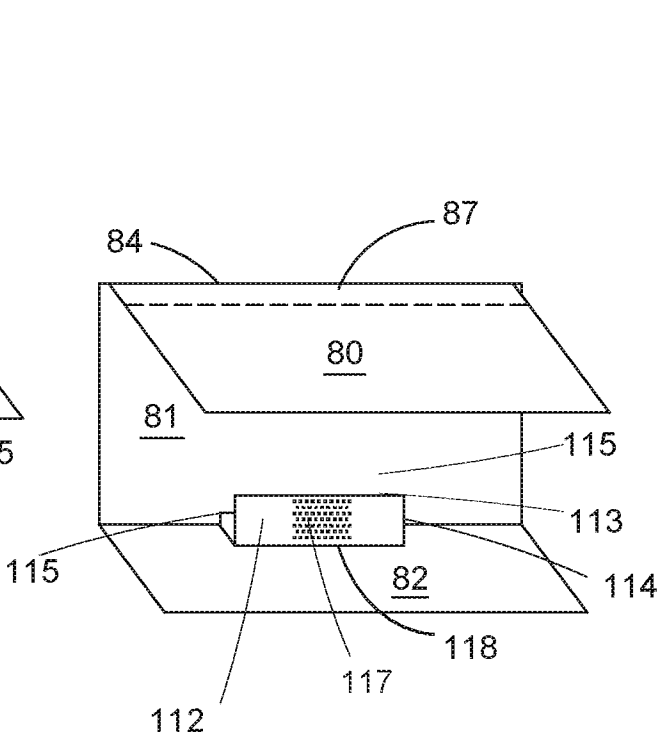
FIG. 6*c* is the second step in the assembly and deployment of the folding recessed truss.
Figure 6B:
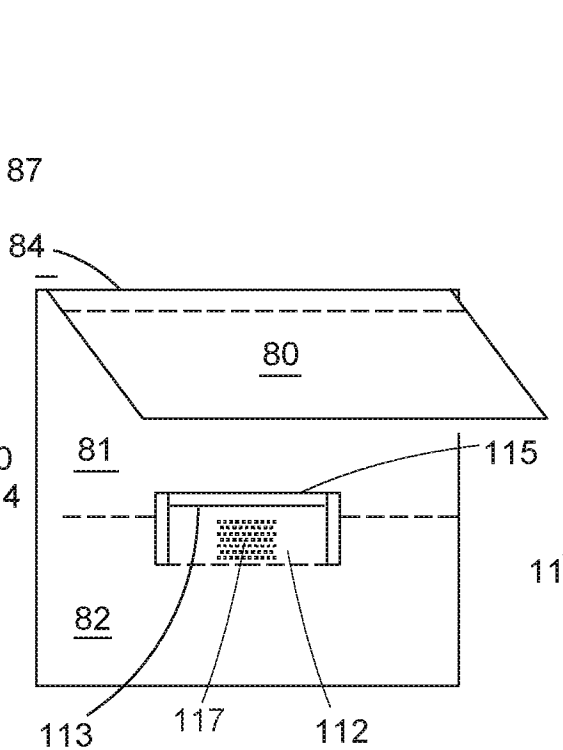
FIG. 6*b* is a first step in the assembly and deployment of the folding recessed truss.
Figure 6A:
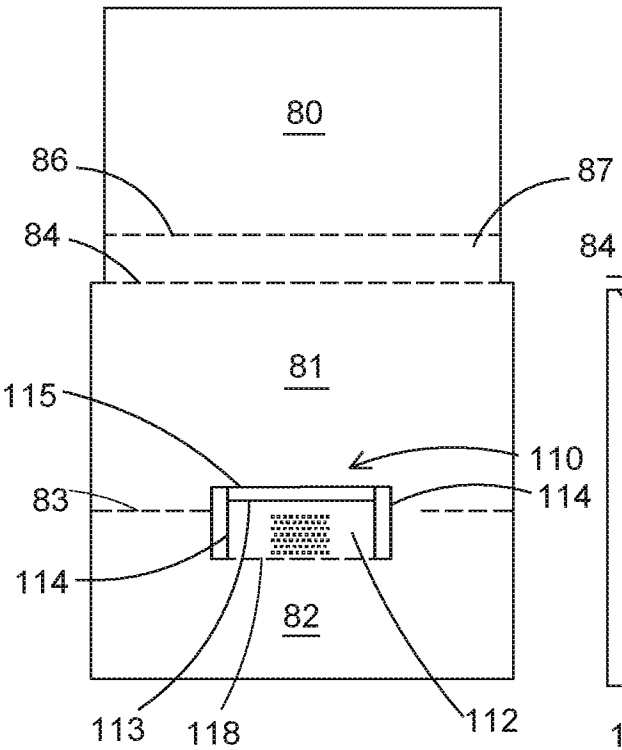
FIG. 6*a* is a first plan view of a folding recessed truss for a reinforced sidewall.
Figure 6E:
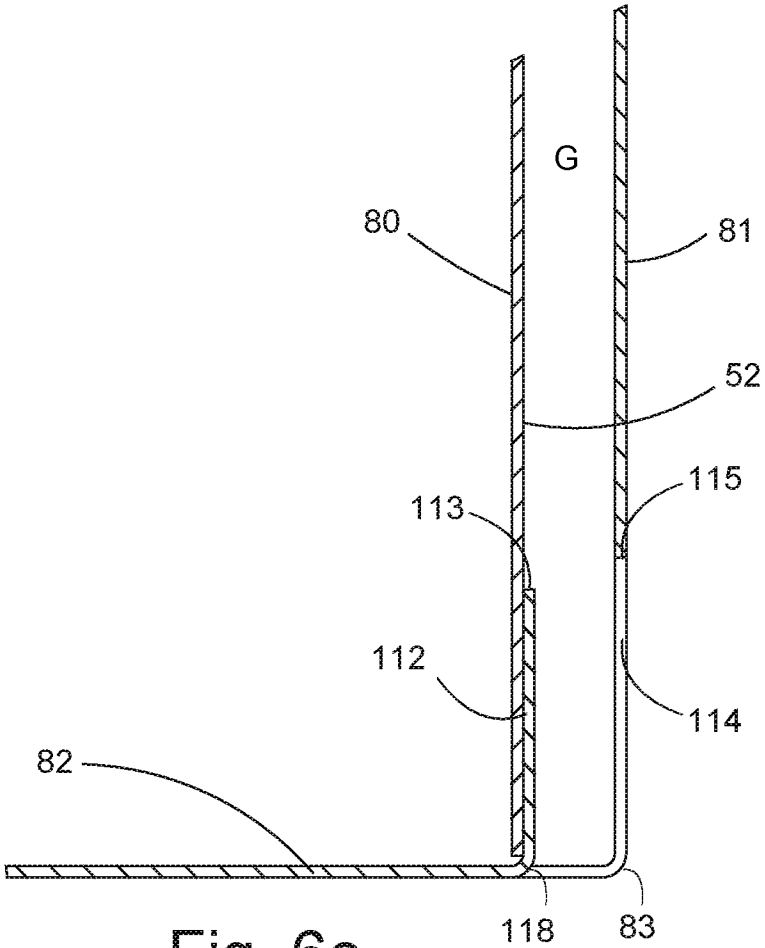
FIG. 6*e* is a detailed interior view of shoulder section 20 in its erected position.
Figure 6D:
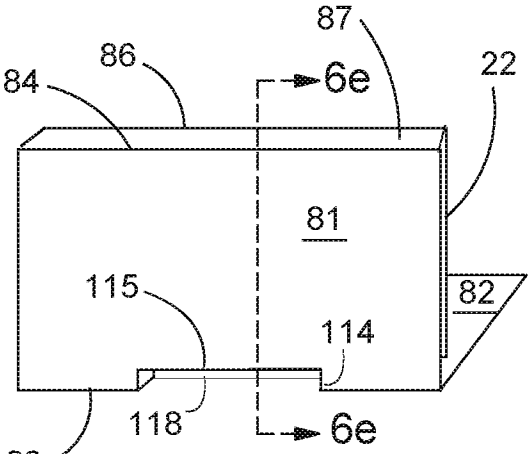
FIG. 6*d* is a third step in the assembly and deployment of the folding recessed truss.

Assembly of the reinforced sidewall of the fifth embodiment is shown in reference to FIG. 5*d*. In an initial step, the interior sidewall 80 is folded along the top fold line 84 and is positioned to overly the outer sidewall 81, with a top edge of the interior sidewall 80 overlying the bottom panel 82 along the bottom fold line 83. As the outer sidewall 81 and the interior sidewall 80 are elevated to their upright position, a bottom edge of the interior sidewall 80 is urged upwardly and the shoulder 97 is automatically formed by a flexure along the top fold line 84 and the shoulder fold line 86.

Simultaneously, the stab structure 90 is formed by a separation of the first stab tab 91, the second stab tab 92, and the third stab tab 93 along the stab cut lines 93. As the stab structure 90 is formed the first stab 91 is urged inwardly and the second stab tab 92 and third stab 94 fold along the stab tab fold line 85 to protrude from a top intermediate surface of the shoulder 97.

As indicated previously, each embodiment of the reinforced sidewall may also be provided with the optional folding recessed truss 110. The folding recessed truss 110 is shown in FIGS. 6*a*-6E, with reference numbers to common components shown in the fifth embodiment of the reinforced sidewall of FIGS. 5*a* and 5*b* with the stab structure 90 omitted.

The folding recessed truss 110 provides a structural support truss between the interior sidewall 80 and the outer sidewall 81 when folded to form the SC3S. The folding recessed truss 110 also provides a convenient hand hold for carrying or manipulating the SC3S. When utilized with the stab structures 90 disclosed herein, the folding recessed truss 110 provides a recess to receive the stab structures 90 and provides for a positive indexing of the SC3S for stacking of a superjacent SC3S atop a subjacent SC3S. The indexing of the stab structure 90 with the recess improved stability in the stacked SC3S containers.

As best seen in reference to FIGS. 6*a*-6*e*, the folding recessed truss 110 includes a vertical truss kick-in 112 extending along a lower truss fold line 118 of the folding recessed truss 110. The lower truss fold line 118 is offset from the bottom fold line 83 of the bottom tab 82 by a distance corresponding to a gap G separation between the outer sidewall 81 and the interior sidewall 80 and the width of the shoulder 87, when erected.

A fastener 117, such as a an adhesive or a staple joins the vertical truss kick-in 112 with an inner surface of the interior sidewall 80. Once joined with the interior sidewall 80, the folding recess truss 110 will deploy automatically with the formation of the shoulder 87 and, when provided with the shoulder 87, the stab structure 90.

To facilitate separation of the vertical truss kick-in 112 and automatic erection of the folding recessed truss 110, one of a horizontal truss cut line 115 and/or an intermediate truss cut line 113 spaced apart from the horizontal truss cut line 115 define a top edge of the vertical truss kick-in 112. The horizontal truss cut line 115 is defined above the bottom fold line 83 by a distance corresponding to a vertical height of the folding recess truss 110, when erected. Likewise, one or more vertical truss cut lines 114 defines a lateral edge of the vertical truss kick-in 112 to facilitate separation of the vertical truss kick-in 112 from the outer sidewall 81 and the bottom panel 82. Corrugated material between the horizontal truss cut line 115 and the intermediate truss cut line 113 may be discarded as scrap. Similarly, excess corrugated material between adjacent vertical truss cut lines 114 may be discarded as scrap.

When provided with the optional folding recess truss 110, the assembly and erection of the reinforced sidewall may include applying a fastener or an adhesive to join the vertical recess truss 112 with an inner surface of the interior sidewall 80. Once joined, the folding recess truss 110 will deploy automatically with the formation of the shoulder and the stab structure 90.

When the bottom panel 82 is folded inwardly approaching 90 degrees, the scored and adhered area within the vertical truss cut lines 114 and one of the horizontal truss cut line 115 or the intermediate truss cut line 113 folds inwardly towards the center of the structure creating an alcove of the folding recessed truss 110, including vertical truss kick-in 112 within the confines of the die cut section. Accordingly, the reinforced truss 110 is formed automatically between the bottom panel 82, the outer sidewall 81, and the interior sidewall 80. The folding recess truss 110 area has multiple purposes. First the folding recess truss 110 reinforces the interior sidewall 80 preventing it from imploding or collapsing. Second, the folding recess truss 110 provides a handhold for easier access lifting, carrying, and stacking of the PDQ, often weighing up to 40 lbs. when full of goods. Third, the folding recess truss 110 provides a recess for indexed stacking of the SC3S with the stab structure 90 of a subjacent SC3S.

In use, the SC3S made with the reinforced sidewalls of the present invention may be used for shipment and display of goods in almost any retail environment where packages, preferably of the same size footprint, are stacked on top of each other. The SC3S is also an ideal solution for any manufacturer whose customers require their packaging to withstand the rigors of a demanding supply chain, such as but not limited to club stores.

The SC3S 10 is manufactured to survive: warehouse exposure to elements, such as high humidity; transcontinental and intercontinental transport to retailer distribution centers; and transit or storage environments where pallets of other vendor product maybe stacked on top other theirs. The product stacked on top could substantially outweigh their product.

It should be understood, of course, that the foregoing relates to exemplary embodiments of the invention and that modifications may be made without departing from the spirit and scope of the invention as set forth in the following claims.

What is claimed is:

1. A reinforced sidewall for a shipping container, comprising:

an outer sidewall joined with a bottom panel by a bottom fold line;

an interior sidewall joined with the outer sidewall by a top fold line, opposite the bottom fold line and spaced apart by a dimension corresponding to a height of the reinforced sidewall;

a first pleat joined with the interior sidewall by a first pleat fold line opposite the top fold line; and a second pleat joined with the first pleat along by a second pleat fold line opposite the first pleat fold line, the second pleat adapted to be joined with the bottom panel when the interior sidewall is folded along the top fold line to overlie an inner face of the outer sidewall, such that when the outer sidewall and the interior sidewall are folded towards the bottom panel along the bottom fold line, the second pleat is folded along the second pleat fold line to overlie the first pleat and position the interior sidewall as a brace with the outer sidewall.

2. The reinforced sidewall of claim 1, wherein a portion of one or more of the bottom fold line, the top fold line, the first pleat fold line, and the second pleat fold line further comprises a score line aligned with a corresponding fold line.

3. The reinforced sidewall of claim 1, further comprising: a lateral side edge of the interior sidewall is inset relative to a lateral side edge of the outer sidewall.

4. The reinforced sidewall of claim 1, further comprising: a slot cutout defined along a portion of the first pleat fold line, the slot cutout configured to facilitate a folding of the first pleat along the first pleat fold line, before a folding of the second pleat along the second pleat fold line.

5. A reinforced sidewall for a container, comprising:

an outer sidewall joined with a bottom panel along a bottom fold line, the bottom panel forming at least a portion of a bottom of the container;

a shouldered section joined with the outer sidewall along a top fold line opposite the bottom fold line;

an interior sidewall joined with the shouldered section along a shoulder fold line opposite the top fold line and spaced apart by a dimension corresponding to a width of a shoulder formed by the shouldered section; and a shoulder brace interposed between the shouldered section and the interior sidewall, the shoulder brace joined with the interior sidewall along a shoulder brace fold line, opposite the shoulder fold line, the shoulder brace configured to automatically deploy inwardly towards an interior of the container in a supporting relation between the interior sidewall and the shoulder when the outer sidewall and the interior sidewall are folded towards the bottom panel along the bottom fold line to an upright position; wherein the shouldered section further comprising: a first shoulder section and a second shoulder section joined along an intermediate shoulder fold line.

6. The reinforced sidewall of claim 5, further comprising: a stab structure configured to automatically protrude from an intermediate portion of the shoulder when the outer sidewall and the interior sidewall are folded to the upright position.

7. The reinforced sidewall of claim 6, the stab structure further comprising:

a pair of stab cut lines defined in the intermediate portion of the shoulder, the pair of stab cut lines extending between the top fold line and the shoulder brace fold line; an outer stab tab extending from the top fold line and disposed between the pair of stab cut lines; and an inner stab tab extending from the shoulder brace fold line and disposed between the pair of stab cut lines, the outer stab tab and the inner stab tab configured to automatically protrude above the shoulder when the interior sidewall and the outer sidewall are moved to the upright position.

8. The reinforced sidewall of claim 7, wherein the inner stab tab and the outer stab tab are joined along a stab fold line and form an angled stab.

9. The reinforced sidewall of claim 7, wherein the stab structure further comprises:

a stab shoulder interposed between the outer stab tab and the inner stab tab, the stab shoulder joined with the inner stab tab along a stab shoulder fold line and joined with the outer stab tab along an intermediate shoulder fold line.

10. The reinforced sidewall of claim 5, further comprising:

a vertical truss kick-in formed by a lower truss fold line and a pair of cut lines defined in the bottom panel, wherein the lower truss fold line is parallel to and spaced apart from the bottom fold line, the pair of cut lines extend between the lower truss fold line and the bottom fold line, and the vertical truss kick-in is adherable to a surface of the interior sidewall using an adhesive.

11. A reinforced sidewall for a container, comprising:

an outer sidewall joined with a bottom panel along a bottom fold line and having a height corresponding to a top fold line opposite the bottom fold line;

a shoulder section joined with the outer sidewall along the top fold line; and an interior sidewall joined with the shoulder section along a shoulder fold line opposite the top fold line, the interior sidewall having a height dimensioned to extend from the shoulder fold line to the bottom panel when erected; and a stab structure defined between a pair of stab cut lines extending between the outer sidewall and the interior sidewall through an intermediate portion of the shoulder section, wherein with the interior sidewall folded about the shoulder fold line to overlie the outer sidewall, the shoulder section and the stab structure are configured to automatically move to deploy a shoulder of the shoulder section when the outer sidewall and the interior sidewall are folded towards the bottom panel along the bottom fold line to an upright position; wherein the stab structure further comprising:

an outer stab tab defined along a top edge of the outer sidewall and protruding beyond the top fold line;

an inner stab tab defined along a top edge of the interior sidewall and protruding beyond the shoulder fold line; and a stab shoulder interposed between the inner stab tab and the outerstab tab, wherein the inner stab tab, the outer stab tab, and the stab shoulder form a shouldered stab protrusion when the outer sidewall and the interior sidewall are folded to the upright position.

12. The reinforced sidewall of claim 11, the shoulder section further comprising:

a first shoulder section connected with the outer sidewall;

a second shoulder section connected with the interior sidewall; and an intermediate shoulder fold line connecting the first shoulder section and the second shoulder section.

13. The reinforced sidewall of claim 11, the interior sidewall further comprising:

a shoulder brace defined between the shoulder fold line and a shoulder brace fold line, the shoulder brace configured to deploy to a cantilevered supporting relation between the shoulder and the interior sidewall when the outer sidewall and the interior sidewall are folded to the upright position.

14. The reinforced sidewall of claim 11, further comprising:

an engagement slot defined in the bottom panel; and an engagement tab defined at a distal end of the interior sidewall, wherein the engagement slot is configured to receive the engagement tab when the interior sidewall and the outer sidewall are folded to the upright position.

15. The reinforced sidewall of claim 11, further comprising:

a vertical truss kick-in formed by a lower truss fold line and a pair of cut lines defined in a bottom tab, wherein the lower truss fold line is parallel to and spaced apart from the bottom fold line, the pair of cut lines extend between the lower truss fold line and the bottom fold line, and the vertical truss kick-in is adherable to a surface of the interior sidewall using an adhesive.

16. The container of claim 15 further comprising:

an upper attachment of a horizontal truss kick-in to the outer sidewall along an upper truss fold line that is offset from the bottom fold line by the distance corresponding to the width of the shoulder.

17. The container of claim 16, wherein, when the bottom tab is folded inwardly from the outer sidewall, the vertical truss kick-in is positioned in abutment with an outwardly facing surface the interior sidewall and the horizontal truss kick-in spans a gap between the outer sidewall and the interior sidewall.

* * * * *